US005676331A

United States Patent [19]

Weber

[11] Patent Number: 5,676,331

[45] Date of Patent: Oct. 14, 1997

[54] DISPENSER INCLUDING ORIENTING ELEMENT AND PAPER ROLL WITH COOPERATING END SUPPORTS

[76] Inventor: Franz Weber, D 40699 Erkrath, Am Korresberg 7, Germany

[21] Appl. No.: 705,919

[22] Filed: Aug. 29, 1996

Related U.S. Application Data

[63] Continuation of Ser. No. 341,417, Nov. 17, 1994, abandoned.

[30] Foreign Application Priority Data

Dec. 1, 1993 [DE] Germany ..... 93 18 952.4 U

[51] Int. Cl.[6] ..... B65H 19/00; B65H 16/06

[52] U.S. Cl. ..... 242/560; 242/599.3; 242/560.3

[58] Field of Search ..... 242/596.7, 599.3, 242/560, 560.2, 611.2, 560.3; 312/34.22

[56] References Cited

U.S. PATENT DOCUMENTS

| | | | |
|---|---|---|---|
| 968,035 | 8/1910 | Engelhardt | 242/611.2 X |
| 1,385,418 | 7/1921 | Ayers | 242/611.2 |
| 2,863,614 | 12/1958 | Dove | 246/611.2 X |
| 3,437,388 | 4/1969 | Jespersen | 312/34.22 X |
| 4,295,921 | 10/1981 | Bopst, III | 242/596.7 X |
| 4,307,639 | 12/1981 | DeLuca | 242/560.1 X |
| 4,340,195 | 7/1982 | DeLuca | 242/560 |

*Primary Examiner*—John Q. Nguyen

*Attorney, Agent, or Firm*—Pearne, Gordon, McCoy & Granger LLP

[57] ABSTRACT

A dispenser for rolls of toilet paper comprises a box-like housing having lateral vertical guides for receiving bearing pins mounted on the rolls, the guides each being provided with an entry portion leading from the front face of the housing. The entry portion of one of the lateral guides has an inwardly projecting guiding element which matches an axially extending notch or recess in one of the bearing pins of a paper roll.

6 Claims, 1 Drawing Sheet

DISPENSER INCLUDING ORIENTING ELEMENT AND PAPER ROLL WITH COOPERATING END SUPPORTS

This is a continuation of application Ser. No. 08/341,417, filed Nov. 17, 1994, abandoned.

BACKGROUND OF THE INVENTION AND RELATED ART

The invention relates to a dispenser for paper rolls, in particular toilet paper rolls or the like, of the kind comprising a box-like housing provided with a front face adapted for insertion of the rolls, and side faces each having guide means to receive bearing pins mounted on the roll, the guide means each having a vertical portion in the side face and an entry portion leading thereto from the front face of the housing, for leading into the vertical portion one of the two bearing pins of the paper roll which is being inserted, at least two paper rolls being arranged one above the other so that the lower roll is intended for use and the one above it as a reserve.

In addition the invention relates to a paper roll for such a dispenser with a hollow core on which paper is wound and having plugs arranged at its ends, each of which is provided with a bearing pin fitting into one of the guides in the housing of the dispenser.

Known dispensers of the kind set forth are designed so that paper rolls, and in particular rolls of toilet paper, can be arranged within the housing of the dispenser in such a way that at least a roll which is kept as a reserve does not come unrolled inadvertently, even when it rests on the roll which lies below it and is intended for use, and when the latter is rotated about its axis for removing paper sheets. The housing of the dispenser in such an arrangement contains lateral vertical guides for the bearing pins mounted on the individual paper rolls in order to allow the rolls to rotate about their axes and in order to allow the roll which is kept in reserve to drop down when required.

In order to ensure that the paper rolls are always inserted in the box-like housing in such a way as to be rotated in the right direction it is known to make the two lateral guides of different widths and to provide the plugs for mounting on the paper rolls with bearing pins of correspondingly different diameters.

However, it has been found that even using these measures one cannot avoid paper rolls being inserted back to front, so to speak, and being able to be forced down in the guides in the housing, leading to the result that the added rolls do not drop down in the desired manner and, if this does still occur, they do not rotate in the correct direction and accordingly come unrolled in an unwanted manner, and so jams within the dispenser are not impossible.

SUMMARY OF THE INVENTION

The aim of the invention is to provide the possibility of reliably avoiding incorrect insertion of paper rolls and to achieve correct insertion of the paper rolls in a simple manner.

According to the invention, in a dispenser of the kind set forth, one of the bearing pins has a receiving element, and one of the entry portions has an inwardly projecting guiding element adapted to co-operate with the receiving element on the bearing pin of each roll. The guiding element provided in accordance with the invention in the entry portion of the guide means achieves, in conjunction with the corresponding receiving element in at least the bearing pin of the paper roll, the result that the paper rolls absolutely must be inserted in the correct attitude in the guide means in the housing. Incorrect insertion and introduction of the paper rolls is effectively eliminated because the paper rolls can only enter the vertical portion if the bearing pin on the roll can fit the corresponding guiding element within the entry portion.

Further features of the invention will become apparent from the description and claims.

BRIEF DESCRIPTION OF THE DRAWING

A dispenser for paper rolls and a paper roll suitable for it are illustrated diagrammatically in the drawing, in which.

DETAILED DESCRIPTION OF THE DRAWINGS

Figure 1:
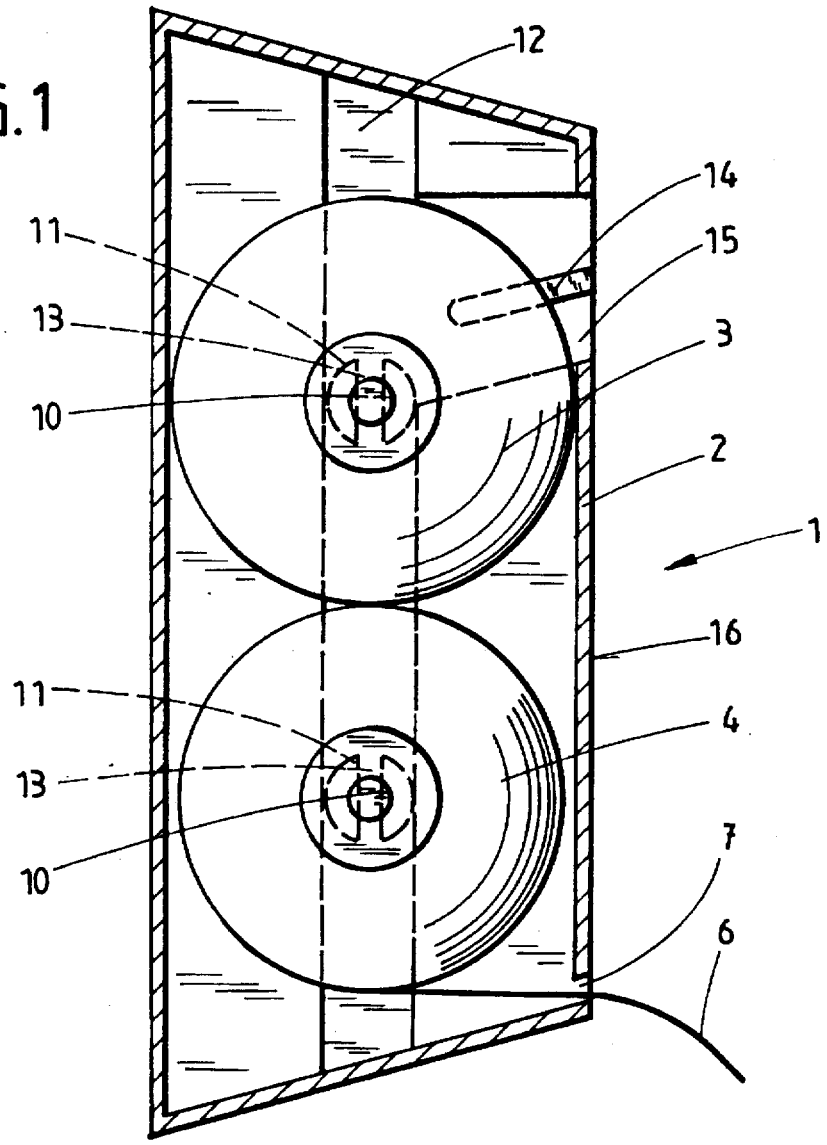
FIG. 1 is a vertical section through the dispenser with two paper rolls mounted in it, one above the other.
Figure 2:
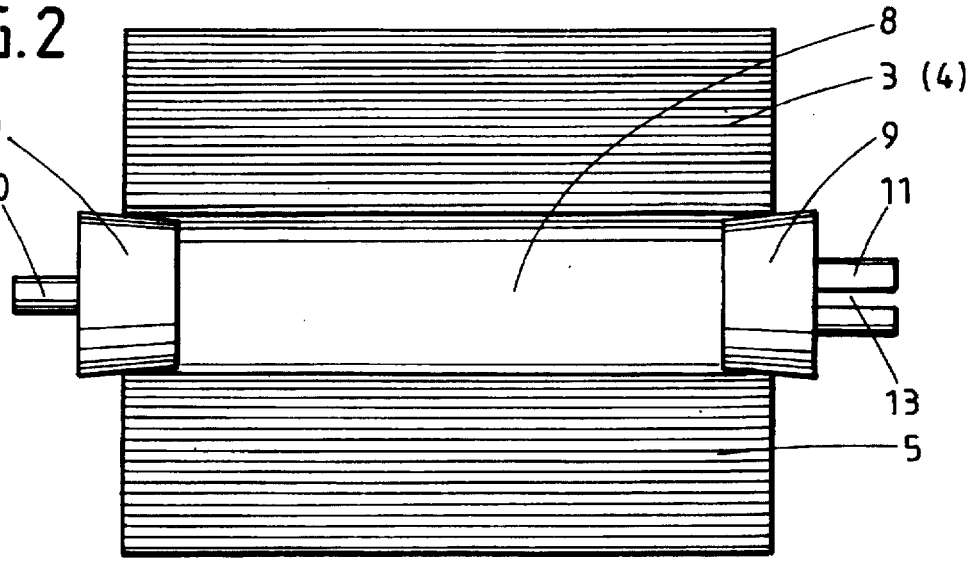
FIG. 2 is a longitudinal section through a paper roll fitting the dispenser of FIG. 1.

The dispenser 1 illustrated in FIG. 1 has a box-like housing 2 designed for receiving two paper rolls 3 and 4 arranged one above the other in the housing 2 as shown in FIG. 1, the lower roll 4 being intended for use and the upper one 3 as a reserve.

Each of the paper rolls 3 and 4 comprises a coil 5 of paper strip 6 provided in a manner not shown with transverse perforations, and the strip can be withdrawn through a slot 7 in the lower end of the housing 2 of the dispenser 1 and can be detached from there.

Each paper roll 3 and 4 contains a hollow core 8 into which a respective plug 9 is inserted from the two ends of the roll. Each of these two plugs 9 has a respective peg or pin 10 and 11 projecting coaxially beyond it. The two pins 10 and 11 serve as bearings or trunnions for the paper roll 3 or 4 and can be of equal or different diameters.

In the embodiment illustrated by way of example the plugs 9 are made conical in order to enable them to be inserted far enough into the hollow core of the associated paper roll 3 or 4 so that a mechanical connection is produced therein interfering with unwinding of the associated roll.

In the embodiment illustrated the plugs 9 are provided with pins 10 and 11 of different diameters to form the bearings and fitting in respective wider and narrower vertical guides 12 in the housing 2.

One of the bearing pins provided on the two plugs 9 namely in this case the plug 11, is provided with a longitudinally extending slot, notch, or groove 13 which fits over a web or rib 14 that serves as a guiding element and is present in a slot-like guide 15 extending in a more or less inclined direction from the front wall 16 of the box-like housing 2 into one of the vertical guides 12. The rib 14 in this arrangement is of such a shape that it does not project into the vertical guide 12 so that the paper roll 3 or 4 inserted through the guides 15 into the housing 2 can fall without restraint into the vertical guides provided laterally in the housing 2. The web 14 has fulfilled its function when the associated paper roll 3 or 4 has been inserted in the housing in the correct attitude, in order to be able to be unrolled in the required manner. The web or rib 14 may be formed of sheet metal.

Although in FIG. 1 the slots 13 in the associated pins 11 of the individual paper rolls 3 and 4 are illustrated as lying vertically, this is not necessary. The position of the slot 13 is only of significance during insertion of the roll 3 or 4 but not once it is in its operating position or reserve position.

It is also possible to provide the longitudinally extending slot 13 in the pin 10 which has the smaller diameter and to arrange the rib 14 which serves as the guiding element in the entry guide 15 leading into the smaller of the two lateral guides 12. It is equally possible, even though generally not necessary, to provide a respective slot 13 in each of the two pins 10 and 11 and correspondingly to provide a rib 14 serving as a guiding element in each of the two entry guides 15, although it will be appreciated that each slot and its associated rib will be different.

What is claimed is:

1. A dispenser for paper rolls in combination with at least one roll having a longitudinal axis extending between longitudinal roll ends and a bearing pin mounted to each of said longitudinal roll ends for supporting the roll as it rotates about said longitudinal axis to dispense paper, said dispenser comprising a box-like housing having a front face joined to a pair of side faces, said front face including an opening for insertion of said roll into said housing, said side faces each including guide means for respectively receiving and supporting said bearing pins and roll within said housing, each of said guide means including an entry portion extending from said front face opening to a vertical portion extending downwardly to a roll paper dispensing position, said portions extending along said side faces within said housing, one of said entry portions having a guiding element projecting from said side face of the dispenser and extending along the entry portion toward said vertical portion, said guiding element having an elongate shape extending from a first end at said front face opening to a second end adjacent said vertical portion of said guide means, one of said bearing pins terminating at a longitudinal end face having a receiving element comprising a radially extending transverse through-slot extending inwardly from said end face to provide a clearance opening, said guiding element projecting toward the longitudinal end of said roll as it is inserted in said dispenser and passing through said clearance opening of said receiving element of said one bearing pin as said roll is moved along said entry portion to permit insertion of a properly oriented roll into said dispenser, said one bearing pin disengaging from said guiding element at said second end thereof to permit said roll to pass between the vertical portions with said bearing pins engaged in said vertical portions and free to rotate with said roll to dispense paper, said guiding element interfering with said other bearing pin if said roll is improperly oriented to inhibit insertion of said roll into said entry portion of said dispenser and thereby regulating the orientation of the roll in the dispenser.

2. The combination set forth in claim 1 wherein said vertical portion comprises a pair of vertically extending support surfaces that receive and engage said one bearing pin.

3. A dispenser as claimed in claim 1, wherein said guiding element is arranged approximately centrally in said entry portion.

4. A dispenser as claimed in claim 1, wherein said guiding element is a rib, said rib extending parallel to a lower edge of said entry portion of said guide means.

5. A dispenser as claimed in claim 4, wherein said rib terminates within said entry portion and before said vertical portion.

6. A paper roll in combination with roll support means for mounting the roll in a dispenser and orienting the roll in the dispenser by cooperation with an elongate guiding element extending along an entry portion of the dispenser, said roll comprising a strip of paper wound around a hollow core, said roll also having opposed ends and a longitudinal axis about which the roll rotates to dispense paper, said support means including plugs selectively engaged in said hollow core at each end of said roll in accordance with desired orientation of the roll in the dispenser, a bearing pin mounted in each of said plugs, one of said bearing pins terminating at a longitudinal end face having a receiving element comprising a radially extending transverse through-slot extending inwardly from said end face to provide a clearance opening at one of the longitudinal ends of said roll, said clearance opening receiving said guiding element to allow said roll to move past said guiding element to permit mounting in the dispenser of a properly oriented roll and to disengage from said clearance opening to allow said roll to rotate to dispense paper, said guiding element interfering with the bearing pin of an improperly oriented roll to inhibit the mounting of the roll in the dispenser and to thereby regulate the orientation of the paper roll in the dispenser.

* * * * *